US006143424A

United States Patent [19]

Jonte et al.

[11] Patent Number: 6,143,424

[45] **Date of Patent: *Nov. 7, 2000**

[54] COATED ARTICLE

[75] Inventors: Patrick B. Jonte, Zionsville, Ind.; William K. Grant, Broomfield, Colo.

[73] Assignee: Masco Corporation of Indiana, Indianapolis, Ind.

[ * ] Notice: This patent is subject to a terminal disclaimer.

[21] Appl. No.: 09/201,041

[22] Filed: Nov. 30, 1998

[51] Int. Cl.[7] ..... B32B 15/04

[52] U.S. Cl. ..... 428/623; 428/627; 428/635; 428/660

[58] Field of Search ..... 428/622, 623, 428/627, 632, 635, 660, 666, 680, 675, 628

[56] References Cited

U.S. PATENT DOCUMENTS

| | | | |
|---|---|---|---|
| 4,904,542 | 2/1990 | Mroczkowski | 428/610 |
| 5,413,874 | 5/1995 | Moysan et al. | 428/627 |
| 5,478,659 | 12/1995 | Moysan et al. | 428/627 |
| 5,547,767 | 8/1996 | Paidassi et al. | 428/610 |
| 5,552,233 | 9/1996 | Moysan et al. | 428/627 |
| 5,626,972 | 5/1997 | Moysan et al. | 428/627 |
| 5,922,478 | 7/1999 | Welty et al. | 428/621 |
| 5,948,548 | 9/1999 | Welty et al. | 428/623 |
| 5,952,111 | 9/1999 | Sugg et al. | 428/623 |
| 5,989,730 | 11/1999 | Sugg et al. | 428/621 |

*Primary Examiner*—John J. Zimmerman
*Attorney, Agent, or Firm*—Myron B. Kapustij; Lloyd D. Doigan

[57] ABSTRACT

An article having a coating comprising at least one nickel layer, a chrome layer, a sandwich layer comprised of titanium compound or titanium alloy compound layers alternating with titanium or titanium alloy layers, and a zirconium compound or zirconium alloy compound layer.

14 Claims, 1 Drawing Sheet

COATED ARTICLE

FIELD OF THE INVENTION

This invention relates to decorative and protective coatings.

BACKGROUND OF THE INVENTION

It is currently the practice with various brass articles such as lamps, trivets, faucets, door knobs, door handles, door escutcheons and the like to first buff and polish the surface of the article to a high gloss and to then apply a protective organic coating, such as one comprised of acrylics, urethanes, epoxies, and the like, onto this polished surface. This system has the drawback that the requisite buffing and polishing operation, particularly if the article is of a complex shape, is labor intensive. Also, the known organic coatings are not as durable as desired and wear off.

These deficiencies are remedied by a coating containing a nickel basecoat and a non-precious refractory metal compound such as zirconium nitride, titanium nitride and zirconium-titanium alloy nitride top coat. However, it has been discovered that when titanium is present in the coating, for example as titanium nitride or zirconium-titanium alloy nitride, in corrosive environments the coating may experience galvanic corrosion. This galvanic corrosion renders the coating virtually useless. It has been surprisingly discovered that the presence of a layer comprised of zirconium compound, such as zirconium nitride, or a zirconium alloy compound over the layers containing the titanium compound or titanium alloy compound significantly reduces or eliminates galvanic corrosion.

SUMMARY OF THE INVENTION

The present invention is directed to a protective and decorative coating for a substrate, particularly a metallic substrate. More particularly, it is directed to a substrate, particularly a metallic substrate such as brass, having on at least a portion of its surface a coating comprised of multiple superposed metallic layers of certain specific types of metals or metal compounds wherein at least one of the layers contains titanium or a titanium alloy. The coating is decorative and also provides corrosion, wear and chemical resistance. In one embodiment the coating provides the appearance of polished brass with a golden hue, i.e. has a golden-brass color tone. Thus, an article surface having the coating thereon simulates polished brass with a gold hue.

A first layer deposited directly on the surface of the substrate is comprised of nickel. The first layer may be monolithic, i.e., a single nickel layer, or it may consist of two different nickel layers such as a semi-bright nickel layer deposited directly on the surface of the substrate and a bright nickel layer superimposed over the semi-bright nickel layer. Over the nickel layer is a layer comprised of chrome. Over the chrome layer is a sandwich layer comprised of layers of titanium or titanium alloy alternating with a titanium compound or a titanium alloy compound.

The sandwich layer is so arranged that a titanium or titanium alloy layer is on the chrome layer, i.e., is the bottom layer, and the titanium compound or titanium alloy compound layer is the top or exposed layer.

Over the top titanium compound or titanium alloy compound layer of the sandwich layer is a thin layer comprised of zirconium compound or zirconium alloy compound. This layer functions to reduce or eliminate galvanic corrosion.

DESCRIPTION OF THE PREFERRED EMBODIMENT

Figure 1:
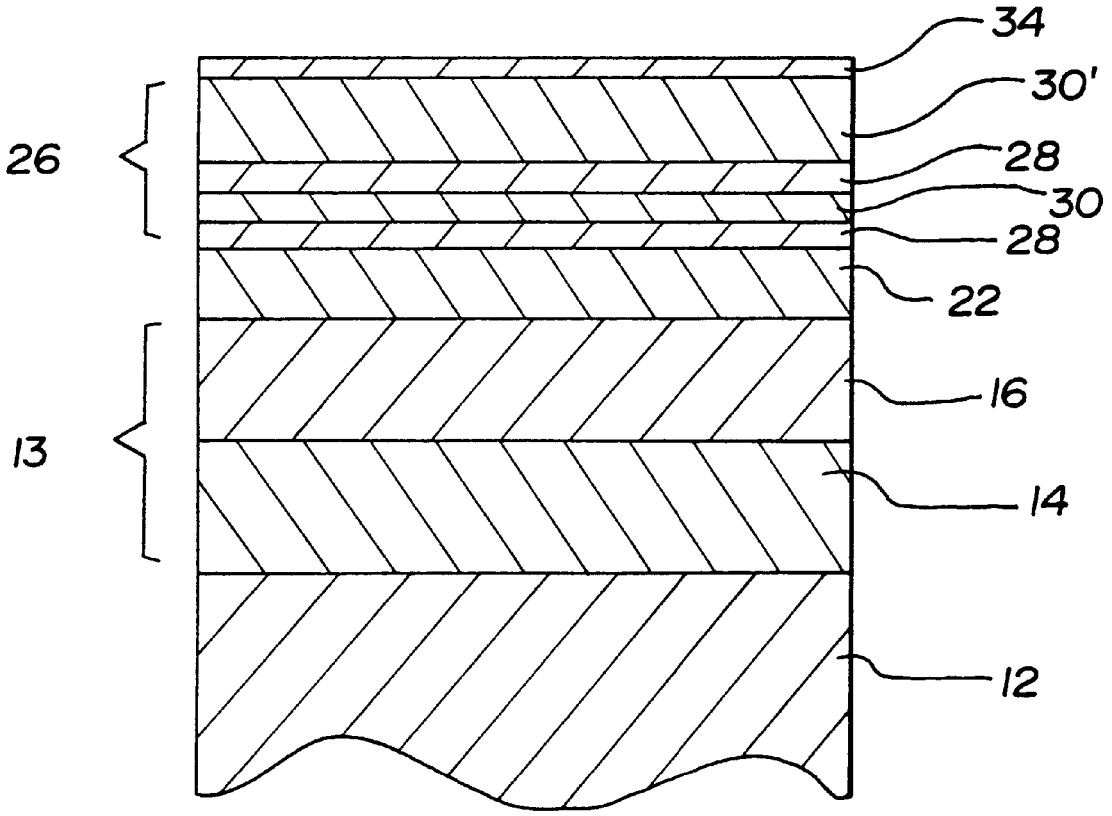
FIG. 1 is a cross-sectional view, not to scale, of the multi-layer coating on a substrate.

The substrate 12 can be any plastic, metal or metallic alloy. Illustrative of metal and metal alloy substrates are copper, steel, brass, tungsten, nickel alloys and the like. In one embodiment the substrate is brass.

A nickel layer 13 is deposited on the surface of the substrate 12 by conventional and well known electroplating processes. These processes include using a conventional electroplating bath such as, for example, a Watts bath as the plating solution. Typically such baths contain nickel sulfate, nickel chloride, and boric acid dissolved in water. All chloride, sulfamate, and fluoroborate plating solutions can also be used. These baths can optionally include a number of well known and conventionally used compounds such as leveling agents, brighteners, and the like. To produce specularly bright nickel layer at least one brightener from class I and at least one brightener from class II is added to the plating solution. Class I brighteners are organic compounds which contain sulfur.

Class II brighteners are organic compounds which do not contain sulfur. Class II brighteners can also cause leveling and, when added to the plating bath without the sulfur-containing class I brighteners, result in semi-bright nickel deposits. These class I brighteners include alkyl naphthalene and benzene sulfonic acid. The benzene and naphthalene di- and trisulfonic acids, benzene and naphthalene sulfonamides, and sulfonamides such as saccharin, vinyl and allyl sulfonamides and sulfonic acids. The class II brighteners generally are unsaturated organic materials such as, for example, acetylenic or ethylenic alcohols, ethoxylated and propoxylated acetylenic alcohols, coumarins, and aldehydes. These class I and class II brighteners are well known to those skilled in the art and are readily commercially available. They are described, inter alia, in U.S. Pat. No. 4,421,611 incorporated herein by reference.

The nickel layer 13 can be comprised of a single nickel layer such as, for example, bright nickel, or it can be comprised of two different nickel layers such as a semi-bright nickel layer and a bright nickel layer. In the figures layer 14 is comprised of semi-bright nickel while layer 16 is comprised of bright nickel. This duplex nickel deposit provides improved corrosion protection to the underlying substrate. The semi-bright, sulfur free plate 14 is deposited by conventional electroplating processes directly on the surface of substrate 12. The substrate 12 containing the semi-bright nickel layer 14 is then plated in a bright nickel plating bath and the bright nickel layer 16 is deposited on the semi-bright nickel layer 14, also by conventional electroplating processes.

The thickness of the nickel layer 13 is generally in the range of from about 100 millionths (0.0001) of an inch, preferably from about 150 millionths (0.00015) of an inch to about 3,500 millionths (0.0035) of an inch.

In the embodiment where a duplex nickel layer is used, the thickness of the semi-bright nickel layer and the bright nickel layer is a thickness effective to provide improved corrosion protection. Generally, the thickness of the semi-bright nickel layer 14 is at least about 50 millionths (0.00005) of an inch, preferably at least about 100 millionths (0.0001) of an inch, and more preferably at least about 150 millionths (0.00015) of an inch. The upper thickness limit is generally not critical and is governed by secondary considerations such as cost and appearance. Generally, however, a thickness of about 1,500 millionths (0.0015) of an inch, preferably about 1,000 millionths (0.001) of an inch, and more preferably about 750 millionths (0.0075) of an inch should not be exceeded. The bright nickel layer 1 generally has a thickness of at least about 50 millionths (0.00005) of an inch, preferably at least about 125 millionths (0.000125) of an inch, and more preferably at least about 250 millionths (0.00025) of an inch. The upper thickness range of the bright nickel layer is not critical and is generally controlled by considerations such as cost. Generally, however, a thickness of about 2,500 millionths (0.0025) of an inch, preferably about 2,000 millionths (0.002) of an inch, and more preferably about 1,500 millionths (0.0015) of an inch should not be exceeded. The bright nickel layer 16 also functions as a leveling layer which tends to cover or fill in imperfections in the substrate.

Disposed over the nickel layer 13, particularly the bright nickel layer, s a layer 22 comprised of chrome. The chrome layer 22 may be deposited on layer 13 by conventional and we 1 known chromium electroplating techniques. These techniques along with various chrome plating baths are disclosed in Brassard, "Decorative Electroplating—A Process in Transition", Metal Finishing, pp. 105–108, June 1988; Zaki, "Chromium Plating", PF Directory, pp. 146–160; and in U.S. Pat. Nos. 4,460,438, 4,234,396 and 4,093,522, all of which are incorporated herein by reference.

Chrome plating baths are well known and commercially available. A typical chrome plating bath contains chromic acid or sales thereof, and catalyst ion such as sulfate or fluoride. The catalyst ions can be provided by sulfuric acid or its salts and fluosilicic acid. The baths may be operated at a temperature of about 112°–116° F. Typically in chrome plating a current density of about 150 amps per square foot, at about 5 to 9 volts is utilized.

The chrome layer 22 serves to provide structural integrity to sandwich layer 26 or reduce or eliminate plastic deformation of the coating. The nickel layer 13 is relatively soft compared to the sandwich layer 26. Thus, an object impinging on, striking or pressing on layer 26 will not penetrate this relatively hard layer, but this force will be transferred to the relatively soft underlying nickel layer 13 causing plastic deformation of this layer. Chrome layer 22, being relatively harder than the nickel layer, will generally resist the plastic deformation that the nickel layer 13 undergoes.

Chrome layer 22 has a thickness at least effective to provide structural integrity to and reduce plastic deformation of the coating. This thickness is at least about 2 millionths (0.000002) of an inch, preferably at least about 5 millionths (0.000005) of an inch, and more preferably at least a out 8 millionths (0.000008) of an inch. Generally, the upper range of thickness is not critical and is determined by secondary considerations such as cost. However, the thickness of the chrome layer should generally not exceed bout 60 millionths (0.00006) of an inch, preferably about 50 millionths (0.00005) of an inch, and more preferably about 40 millionths (0.00004) of an inch.

Disposed over chrome layer 22 is a sandwich layer 26 comprised of layers 30 comprised of titanium or titanium alloy alternating with layers 28 comprised of titanium compound or titanium alloy compound. Such a structure is illustrated in the figure wherein 26 represents the sandwich layer, 28 represents a layer comprised of a titanium compound or a titanium alloy compound, and 30 represents a layer comprised of titanium or titanium alloy.

The metals that are alloyed with the titanium to form the titanium alloy or titanium alloy compound are the non-precious refractory metals. These include zirconium, hafnium, tantalum, an tungsten. The titanium alloys generally comprise from about 10 to about 90 weight percent titanium and from about 90 to about 10 weight percent of another non-precious refractory metal, preferably from about 20 to about 80 weight percent titanium and from about 80 to about 20 weight percent of another refractory metal. The titanium compounds or titanium alloy compounds include the oxides, nitrides, carbides and carbonitrides.

In one embodiment layers 30 are comprised of titanium-zirconium alloy nitrides and layers 28 are comprised of titanium-zirconium alloy. In this embodiment the titanium-zirconium alloy nitride layer has a brass color with a golden hue.

The sandwich layer 26 has a thickness effective to provide abrasion, scratch and wear resistance and to provide the requisite color, e.g., when titanium-zirconium alloy nitride comprise layer 28 a golden hued brass color. Generally layer 26 has an average thickness of from about two millionths (0.000002) of an inch to about 40 millionths (0.00004) of an inch, preferably from about four millionths (0.000004) of an inch to about 35 millionths (0.000035) of an inch, and more preferably from about six millionths (0.000006) of an inch to about 30 millionths (0.00003) of an inch.

Each of layers 28 and 30 generally has a thickness of at least about 0.01 millionths (0.00000001) of an inch, preferably at least about 0.25 millionths (0.00000025) of an inch, and more preferably at least about 0.5 millionths (0.0000005) of an inch. Generally, layers 28 and 30 should not be thicker than about 15 millionths (0.000015) of an inch, preferably about 10 millionths (0.00001) of an inch, and more preferably a out 5 millionths (0.000005) of an inch.

In the sandwich layer the bottom layer is layer 28, i.e., the layer composed of titanium or titanium alloy. The bottom layer 28 is disposed on the chrome layer 22. The top layer of the sandwich layer is layer 30'. Layer 30' is comprised of titanium compound or titanium alloy compound. Layer 30' is the color layer. That is to say it provides the color to the coating. In the case of titanium-zirconium alloy nitride it is a brass color with a golden hue. Layer 30' has a thickness which is at least effective to provide the requisite color, e.g., brass color with a golden hue. Generally, layer 30' can have a thickness which is abut the same as the thickness of the remainder of the sandwich layer. Layer 30' is the thickest of layer 28, 30 comprising the sandwich layer. Generally, layer 30' has a thickness of at least about 2 millionths, preferably at least about 5 millionths of an inch. Generally a thickness of about 50 millionths, preferably about 30 millionths of an inch, should not be exceeded.

A method of forming the sandwich layer 26 is by utilizing well known and conventional vapor deposition techniques such as physical vapor deposition or chemical vapor deposition. Physical vapor deposition processes include sputtering and cathodic arc evaporation. In one process of the instant invention sputtering or cathodic arc evaporation is used to deposit a layer 30 of titanium alloy or titanium followed by reactive sputtering or reactive cathodic arc evaporation to deposit a layer 28 of titanium alloy compound such as titanium-zirconium nitride or titanium compound such as titanium nitride.

To form sandwich layer 26 wherein the titanium compound and the titanium alloy compound are the nitrides, the flow rate of nitrogen gas is varied (pulsed) during vapor deposition such as reactive sputtering or reactive cathodic arc evaporation between zero (no nitrogen gas or a reduced value is introduced) to the introduction of nitrogen at a desired value to form multiple alternating layers of titanium 30 and titanium alloy nitride 28 in the sandwich layer 26.

The number of alternating layers of titanium or titanium alloy 30 and titanium or titanium alloy compound layers 28 in sandwich layer 26 is a number effective to reduce or eliminate cracking. This number is generally at least about 4, preferably at least about 6, and more preferably at least about 8. Generally, the number of alternating layers of refractory metal 30 and refractory metal compound 28 in sandwich layer 26 should not exceed about 50, preferably about 40, and more preferably about 30.

The sandwich layer 26 reduces or eliminates stress cracking of the coating and improves the chemical resistance of the coating.

Over layer 30' is layer 34. Layer 34 is comprised of a zirconium compound of a zirconium alloy compound. The zirconium compounds or zirconium alloy compounds are the oxides, nitrides, carbides and carbonitrides. The metals that are alloyed with zirconium to form the zirconium alloy compounds are the non-precious refractory metal compounds excluding titanium. The zirconium alloy comprises from about 30 to about 90 weight percent zirconium, the remainder being non-precious refractory metal other than titanium; preferably from about 40 to about 90 weight percent zirconium, he remainder being non-precious refractory metal other than titanium; and more preferably from about 50 to about 90 weight percent zirconium, the remainder being non-precious refractory metal other than titanium.

Layer 34 may be, for example, zirconium nitride when layer 30 is zirconium-titanium alloy nitride.

Layer 34 is very thin. It is thin enough so that it is non-opaque, translucent or transparent in order to allow the color of layer 30' to be seen. It must, however, be thick enough to significantly reduce or eliminate galvanic corrosion. Generally layer 34 has a thickness from about 0.07 millionths to about 0.7 millionths, preferably from about 0.2 millionths to about 0.3 millionths of an inch.

Layer 34 can be deposited by well known and conventional vapor deposition techniques, including physical vapor deposition and chemical vapor deposition such as, for example, reactive sputtering and reactive cathodic arc evaporation.

Sputtering techniques and equipment are disclosed, inter alia, in J. Vossen and W. Kern "Thin Film Processes II", Academic Press, 1991; R. Boxman et al, "Handbook of Vacuum Arc Science and Technology", Noyes Pub., 1995; and U.S. Pat. Nos. 4,162,954 and 4,591,418, all of which are incorporated herein by reference.

Briefly, in the sputtering deposition process a refractory metal (such as titanium or zirconium) target, which is the cathode, and the substrate are placed in a vacuum chamber. The air in the chamber is evacuated to produce vacuum conditions in the chamber. An inert gas, such as Argon, is introduced into the chamber. The gas particles are ionized and are accelerated to the target to dislodge titanium or zirconium atoms. The dislodged target material is then typically deposited as a coating film on the substrate.

In cathodic arc evaporation, an electric arc of typically several hundred amperes is struck on the surface of a metal cathode such as zirconium or titanium. The arc vaporizes the cathode material, which then condenses on the substrates forming a coating.

Reactive cathodic arc evaporation and reactive sputtering are general by similar to ordinary sputtering and cathodic arc evaporation except that a reactive gas is introduced into the chamber which reacts with the dislodged target material. Thus in the case where zirconium nitride is the layer 32, the cathode is comprised of zirconium and nitrogen is the reactive gas introduced into the chamber by controlling the amount of nitrogen available to react with the zirconium, the color of the zirconium nitride can be adjusted to be similar to that of brass of various hues.

In order that the invention may be more readily understood the following example is provided. The example is illustrative and does not limit the invention thereto.

EXAMPLE 1

Brass faucets are placed in a conventional soak cleaner bath containing the standard and well known soaps, detergents, defloculants and the like which is maintained at a pH of 8.9–9.2 and a temperature of 180–200° F. for about 10 minutes. The brass faucets are then placed in a conventional ultrasonic alkaline cleaner bath. The ultrasonic cleaner bath has a pH of 8.9–9.2, is maintained at a temperature of about 160–180° F., and contains the conventional and well known soaps, detergents, defloculants and the like. After the ultrasonic cleaning the faucets are rinsed and placed in a conventional alkaline electro cleaner bath. The electro cleaner bath is maintained at a temperature of about 140–180° F., a pH of about 10.5–11.5, and contains standard and conventional detergents. The faucets are then rinsed twice and placed in a conventional acid activator bath. The acid activator bath has a pH of about 2.0–3.0, is at an ambient temperature, and contains a sodium fluoride based acid salt. The faucets are then rinsed twice and placed in a bright nickel plating bath for about 12 minutes. The bright nickel bath is generally a conventional bath which is maintained at a temperature of 130–150° F., a pH of about 4.0, contains $NiSO_4$, $NiCL_2$, boric acid, and brighteners. A bright nickel layer of an average thickness of about 400 millionths (0.0004) of an inch is deposited on the faucet surface. The bright nickel plated faucets are rinsed three times and then placed in a conventional, commercially available hexavalent chromium plating bath using conventional chromium plating equipment for about seven minutes. The hexavalent chromium bath is a conventional and well known bath which contains about 32 ounces/gallon of chromic acid. The bath also contains the conventional and well known chromium plating additives. The bath is maintained at a temperature of about 112°–116° F., and utilizes a mixed sulfate/fluoride catalyst. The chromic acid to sulfate ratio is about 200:1. A chromium layer of about 10 millionths (0.00001) of an inch is deposited on the surface of the bright nickel layer. The faucets are thoroughly rinsed in deionized water and then dried. The chromium plated faucets are placed in a cathodic arc evaporation plating vessel. The vessel is generally a cylindrical enclosure containing a vacuum chamber which is adapted to be evacuated by means of pumps. A source of argon gas is connected to the chamber by an adjustable valve for varying the rate of flow of argon into the chamber. In addition, a source of nitrogen gas is connected to the chamber by an adjustable valve for varying the rate of flow of nitrogen into the chamber.

A cylindrical cathode is mounted in the center of the chamber and connected to negative outputs of a variable D.C. power supply. The positive side of the power supply is connected to the chamber wall. The cathode material comprises titanium-zirconium alloy.

The plated faucets are mounted on spindles, 16 of which are mounted on a ring around the outside of the cathode. The entire ring rotates around the cathode while each spindle also rotates around its own axis, resulting in a so-called planetary motion which provides uniform exposure to the cathode for the multiple faucets mounted around each spindle. The ring typically rotates at several rmp, while each spindle makes several revolutions per ring revolution. The spindles are electrically isolated from the chamber and provided with rotatable contacts so that a bias voltage may be applied to the substrates during coating.

The vacuum chamber is evacuated to a pressure of about $5\times10^{-3}$ millibar and heated to about 150° C.

The electroplated faucets are then subjected to a high-bias arc plasma cleaning in which a (negative) bias voltage of about 500 volts is applied to the electroplated faucets while an arc of approximately 500 amperes is struck and sustained on the cathode. The duration of the cleaning is approximately five minutes.

Argon gas is introduced at a rate sufficient to maintain a pressure of about $3\times10^{-2}$ millibars. A layer of titanium-zirconium alloy having an average thickness of about 4 millionths (0.000004) of an inch is deposited on the chrome plated faucets during a three minute period. The cathodic arc deposition process comprises applying D.C. power to the cathode to achieve a current flow of about 500 amps, introducing argon gas into the vessel to maintain the pressure in the vessel at about $1\times10^{-2}$ millibar, and rotating the faucets in a planetary fashion described above.

After the titanium-zirconium alloy layer is deposited the sandwich layer is applied onto the titanium-zirconium alloy layer. A flow of nitrogen is introduced into the vacuum chamber periodically while the arc discharge continues at approximately 500 amperes. The nitrogen flow rate is pulsed, i.e. changed periodically from a maximum flow rate sufficient to fully react the titanium-zirconium atoms arriving at the substrate to form titanium-zirconium alloy nitride, and a minimum flow rate equal to zero or some lower value not sufficient to fully react with all the titanium-zirconium alloy. The period of the nitrogen flow pulsing is one to two minutes (30 seconds to one minute on, then off). The total time for pulsed deposition is about 15 minutes, resulting in a sandwich stack with 10 layers of thickness of about one to 1.5 millionths of an inch each. The deposited material in the sandwich layer alternates between fully reacted titanium-zirconium alloy nitride and titanium-zirconium alloy metal (or substoichiometric titanium-zirconium alloy nitride with much smaller nitrogen content).

After the sandwich layer is deposited, the nitrogen flow rate is left at its maximum value (sufficient to form fully reacted titanium-zirconium alloy nitride) for a time of five to ten minutes to form a thicker "color layer" of titanium-zirconium alloy nitride on top of the sandwich layer.

The titanium-zirconium alloy cathode in the cathodic arc evaporation chamber is replaced with a zirconium cathode. The chamber is again evacuated to pressure as previously described. The parts are cleaned again by subjecting them to high-bias arc plasma as described previously. After cleaning the cathodic arc deposition process is repeated with nitrogen and argon gas flows set to provide complete or nearly complete reaction of the zirconium metal to zirconium nitride. This flash process is carried out for about a one to three minute period. A thin layer of about 0.2 millionths of an inch of zirconium nitride is deposited on the titanium-zirconium alloy nitride color layer.

The arc is extinguished at the end of this last deposition period, the vacuum chamber is vented and the coated substrates removed.

While certain embodiments of the invention have been described for purposes of illustration, it is to be understood that there may be various embodiments and modifications within the general scope of the invention.

What is claimed is:

1. An article having on at least a portion of its surface a coating comprising, in order:

at least one layer comprised of nickel;

layer comprised of chrome;

layer comprised of titanium or titanium alloy;

sandwich layer comprised of plurality of layers comprised of titanium compound or titanium alloy compound alternating with layers comprised of titanium or titanium alloy;

color layer comprised of titanium compound or titanium alloy compound; and thin layer comprised of zirconium compound or zirconium alloy compound.

2. The article of claim 1 wherein said titanium compound is titanium nitride and said titanium alloy compound is titanium-zirconium alloy nitride.

3. The article of claim 2 wherein said titanium alloy is titanium-zirconium alloy.

4. The article of claim 3 wherein said zirconium compound is zirconium nitride.

5. The article of claim 3 wherein said zirconium alloy compound is zirconium alloy nitride.

6. The article of claim 1 wherein said at least one layer comprised of nickel is comprised of bright nickel.

7. An article having on at least a portion of its surface a coating comprising, in order:

layer comprised of semi-bright nickel;

layer comprised of bright nickel;

layer comprised of chrome;

layer comprised of titanium or titanium alloy;

sandwich layer comprised of a plurality of layers comprised of titanium compound or titanium alloy compound alternating with layers comprised of titanium or titanium alloy;

color layer comprised of titanium compound or titanium alloy compound; and thin layer comprised of zirconium compound or zirconium alloy compound.

8. The article of claim 7 wherein said titanium compound is titanium nitride.

9. The article of claim 8 wherein said titanium alloy compound is titanium-zirconium alloy compound.

10. The article of claim 9 wherein said titanium-zirconium alloy compound is titanium-zirconium alloy nitride.

11. The article of claim 10 wherein said zirconium compound is zirconium nitride.

12. The article of claim 10 wherein said zirconium alloy compound is zirconium alloy nitride.

13. The article of claim 7 wherein said zirconium compound is zirconium nitride.

14. The article of claim 7 wherein said zirconium alloy compound is zirconium alloy nitride.

* * * * *